US007696283B2

(12) United States Patent
Ieno et al.

(10) Patent No.: US 7,696,283 B2
(45) Date of Patent: Apr. 13, 2010

(54) FIBER AND A FIBER STRUCTURE HAVING A HIGH FLAME-RETARDING PROPERTY AND HIGH MOISTURE-ABSORPTIVE PROPERTY

(75) Inventors: Masao Ieno, Okayama (JP); Ryosuke Nishida, Okayama (JP)

(73) Assignee: Japan Exlan Company Limited, Osaka (JP)

( * ) Notice: Subject to any disclaimer, the term of this patent is extended or adjusted under 35 U.S.C. 154(b) by 468 days.

(21) Appl. No.: 11/661,918

(22) PCT Filed: Jul. 29, 2005

(86) PCT No.: PCT/JP2005/013933

§ 371 (c)(1),
(2), (4) Date: Mar. 5, 2007

(87) PCT Pub. No.: WO2006/027911

PCT Pub. Date: Mar. 16, 2006

(65) Prior Publication Data

US 2008/0033113 A1 Feb. 7, 2008

(30) Foreign Application Priority Data

Sep. 7, 2004 (JP) ..... 2004-259817
May 31, 2005 (JP) ..... 2005-159209

(51) Int. Cl.
*C08F 8/42* (2006.01)
*C08C 19/26* (2006.01)

(52) U.S. Cl. ..... 525/366; 525/329.1; 525/329.2; 525/376

(58) Field of Classification Search ..... 525/329.1, 525/329.2, 367, 376, 366
See application file for complete search history.

(56) References Cited

U.S. PATENT DOCUMENTS 5,292,822 A * 3/1994 Tanaka et al. ..... 525/329.1

FOREIGN PATENT DOCUMENTS

| | | |
|---|---|---|
| JP | 60-194173 | 10/1985 |
| JP | 1-314780 | 12/1989 |
| JP | 2-84528 | 3/1990 |
| JP | 2-84532 | 3/1990 |
| JP | 2-91271 | 3/1990 |
| JP | 4-185764 | 7/1992 |
| JP | 5-132858 | 5/1993 |
| JP | 7-216730 | 8/1995 |
| JP | 8-325938 | 12/1996 |
| JP | 9-59872 | 3/1997 |
| JP | 10-237743 | 9/1998 |
| JP | 2000-27064 | 1/2000 |
| JP | 2001-303342 | * 10/2001 |
| JP | 2003-89971 | 3/2003 |

* cited by examiner

*Primary Examiner*—Ling-Siu Choi
(74) *Attorney, Agent, or Firm*—Wenderoth, Lind & Ponack, L.L.P.

(57) ABSTRACT

The present invention provides fiber and a fiber structure having a high flame-retarding property and high moisture-absorptive property which do not generate noxious gases such as hydrogen halide gas upon burning, do not elute heavy metal compounds and phosphorus compounds therefrom even when reclaimed upon discarding including a burning treatment and have an excellent processing property.

The present invention discloses a highly flame-retarding and moisture-absorptive fiber, characterized in that, it comprises an organic polymer having a cross-linking structure and a salt-type carboxyl group in which at least a part of such a salt-type carboxyl group is a magnesium salt type and a saturated moisture absorption rate at 20° C. and 65% relative humidity and a limiting oxygen index are not less than 35% by weight and not less than 35, respectively, and a flame-retarding fiber structure wherein the highly flame-retarding and moisture-absorptive fiber is used in at least a part of the structure.

7 Claims, No Drawings

FIBER AND A FIBER STRUCTURE HAVING A HIGH FLAME-RETARDING PROPERTY AND HIGH MOISTURE-ABSORPTIVE PROPERTY

TECHNICAL FIELD OF THE INVENTION

The present invention relates to fiber and a fiber structure having a high flame-retarding property and a high moisture-absorptive property and, more particularly, it relates to fiber and a fiber structure having a high flame-retarding property and high moisture-absorptive property which do not generate noxious gases such as hydrogen halide gas upon burning, do not elute heavy metal compounds and phosphorus compounds therefrom even when reclaimed upon discarding including a burning treatment and have an excellent processing property.

BACKGROUND ART

Up to now, many methods have been proposed for preparing a flame-retarding fiber and one of them is a post-processing method where a flame retardant such as phosphorus compound or halogen compound is adhered and fixed on the surface of the fiber but, in that method, it is difficult to adhere a lot of the flame retardant as such so that it is difficult to prepare a fiber having a high flame-retarding property and, in addition, there are various problems such as durability, changes in texture and toxicity of the flame retardant itself and also upon burning.

A representative example of other methods is a method where fiber is formed using a polymer in which a halide monomer such as vinyl halide and vinylidene halide is copolymerized but, in that method, it is necessary to copolymerize a halide monomer in large amount for preparing a highly flame-retarding fiber and, as a result, there is also an essential disadvantage such as generation of noxious gases upon burning.

Against the problems as such, flame-retarding fibers in which carboxyl group obtained by a hydrolysis reaction of a cross-linked acrylate fiber is cross-linked by a polyvalent metal ion such as zinc, copper, calcium and iron have been proposed in Japanese Patent Laid-Open Nos. 01/314,780, 02/084,528 and 02/084,532. However, a limiting oxygen index (hereinafter, it will be referred to as LOI) showing the degree of flame-retarding property is as high as 37 in the fiber where vinylidene chloride which is a halide monomer is used but, when no halide monomer is used, it is 34 at the highest.

In Japanese Patent Laid-Open No. 04/185,764, there is a proposal for a cross-linked acrylate fiber where an increase in nitrogen content by hydrazine cross-linking is more than a predetermined value in which ionic cross-linking is conducted by copper ion. In that case, a product of a high flame-retarding property where the LOI is up to 35 at the highest is able to be prepared. However, since it uses copper, copper ion which is heavy metal ion causes a problem in its discarding or in discarding after burning.

In the Japanese Patent Laid-Open Nos. 08/325,938 and 09/059,872, there is a description for a moisture-absorptive fiber having a flame-retarding property where carboxyl group is introduced by hydrolysis into an acrylate fiber into which cross-link has been introduced by hydrazine and said carboxyl group is made into a metal salt type selected from the group consisting of calcium, magnesium, aluminum, copper, zinc and iron salt type. However, in the fiber of a calcium salt type disclosed in Examples of those documents, LOI is 30 at the highest and no high flame-retarding property is bestowed. Although moisture-absorptive property is said to be one of the characteristics therein, the moisture-absorptive rate at 20° C. and 65% relative humidity is about 30% at the highest and very high property is not achieved.

In Japanese Patent Laid-Open No. 10/237,743, there are examples for pile cloth as a structure comprising an acrylate fiber where hydrogen and at least one type of metal selected from calcium, magnesium and aluminum are bonded to carboxyl group. However, LOI of the flame-retarding acrylate fiber (trade name: "eks" (trade mark) manufactured by Toyobo) disclosed in Examples of said document is 31 at the highest and the fiber is not highly flame-retarding.

DISCLOSURE OF THE INVENTION

Problems that the Invention is to Solve

An object of the present invention is to provide a highly flame-retarding and moisture-absorptive fiber and fiber structure having advantages that the problems in terms of safety and environment noted in the above-mentioned conventional flame-retarding fiber or flame-retarding fiber structure are solved, that the problems on a flame-retarding level, etc. which have been insufficient in the flame-retarding fibers up to now are solved and that a high moisture-absorptive property as a characteristic which is able to be utilized as clothing, building materials, bedroom decoration, etc. is also available.

Means for Solving the Problems

The above-mentioned objects of the present invention are able to be achieved by the following means.

[1] A highly flame-retarding and moisture-absorptive fiber, characterized in that, it comprises an organic polymer having a cross-linking structure and a salt-type carboxyl group in which at least a part of such a salt-type carboxyl group is a magnesium salt type and a saturated moisture absorption rate at 20° C. and 65% relative humidity and a limiting oxygen index are not less than 35% by weight and not less than 35, respectively.

[2] The highly flame-retarding and moisture-absorptive fiber according to [1], wherein the cross-linking structure comprises an amine structure prepared by the reaction of a hydrazine compound with nitrile group contained in a high nitrile polymer where content of vinyl monomer having nitrile group is not less than 50% by weight.

[3] The highly flame-retarding and moisture-absorptive fiber according to [1] or [2], wherein the salt-type carboxyl group to the fiber is 3 to 9 mmol/g and not less than 70% of such a salt-type carboxyl group is a magnesium salt type.

[4] The highly flame-retarding and moisture-absorptive fiber according to any of [1] to [3], wherein the fiber contains not less than 4% by weight of magnesium.

[5] The highly flame-retarding and moisture-absorptive fiber according to any of [1] to [4], wherein specific gravity of the fiber is not more than 1.8 g/cm$^3$.

[6] A flame-retarding fiber structure, characterized in that, the highly flame-retarding and moisture-absorptive fiber mentioned in any of [1] to [5] is used in at least a part of the structure.

[7] The flame-retarding fiber structure according to [6]wherein a limiting oxygen index is not less than 28.

Advantages of the Invention

Since the highly flame-retarding and moisture-absorptive fiber and fiber structure in accordance with the present invention have a very high flame-retarding property which is not available in the conventional organic fibers, it is now possible to provide a material having a high flame-retarding property which has not been available up to now when the fiber of the present invention is solely used or, even when said fiber is used by mixing with other fiber, a high flame-retarding property is achieved by addition of small amount. In addition, the fiber and the fiber structure of the present invention also show high safety, are advantageous in terms of cost, are environment-friendly upon discarding, and have high moisture-absorptive property and, therefore, it is able to be widely used in a field where conventional fiber products are used such as clothing, building materials and bedroom things or in a field of industrial materials.

BEST MODE FOR CARRYING OUT THE INVENTION

The present invention will now be illustrated in detail as hereunder. Firstly, the highly flame-retarding and moisture-absorptive fiber and fiber structure in accordance with the present invention comprise an organic polymer having cross-linking structure and salt-type carboxyl group and it is necessary that at least a part of the salt-type carboxyl group is a magnesium salt type. The very high flame-retarding property which is the characteristic feature of the present invention is believed to be achieved by a combination of carboxyl group in a form of a salt with magnesium which is a divalent metal and a cross-linking structure which is effective in enhancing the heat resistance.

Magnesium is light metal but, in the case of carboxyl group in a form of a salt with Na, K, Ca or the like which is also light metal, an increase in the flame-retarding property is not so significant even if its content is increased and the resulting LOI value was about 30 at the highest. On the contrary, although magnesium is also light metal as above, a characteristic phenomenon has been found that, when content of carboxyl group which is a magnesium salt type is increased and a content of higher than a predetermined level is achieved, very high flame-retarding property is able to be available whereupon the present invention has been achieved.

With regard to the salt-type carboxyl group of the present invention, at least a part of it is necessary to be a magnesium salt type while, with regard to the type of remaining carboxyl group, there is no particular limitation so far as there is affection on the characteristic feature such as a flame-retarding property which is an object of the present invention and any of H type and salt type is able to be appropriately selected. In the case of a salt type, its examples are alkali light metal such as Li, Na, K, Rb and Cs; alkali earth metal such as Be, Mg, Ca, Sr and Ba; other metal such as Cu, Zn, Al, Mn, Ag, Fe, Co and Ni; and organic cation such as $NH_4$ and amine.

With regard to the amount of the salt-type carboxyl group in which at least a part thereof is to be a magnesium salt type, there is no particular limitation so far as a high flame-retarding property of the present invention is able to be achieved although it is preferred that said group is contained therein as much as possible in order to achieve still higher flame-retarding property. However, in view of a processing property for actual use and also of necessity for suppression of swelling due to absorption of water, there are many cases where an appropriate balance is necessary in the proportion with the cross-linking structure. To be more specific, when the amount of a salt-type carboxyl group is too much or, in other words, when it is more than 9.0 mmol/g, the rate of the cross-linking structure which is able to be introduced is too little and it is difficult to achieve a fiber property required for common processing such as spinning.

On the other hand, when amount of the salt-type carboxyl group is too small, the outcome is that the flame-retarding property lowers and that is not preferred. Especially when it is less than 3.0 mmol/g, the resulting flame-retarding property is particularly low and, in the use where a high flame-retarding property is demanded which is oriented by the present invention, no practical value is achieved any more and that is not preferred. To be practical, when amount of the salt-type carboxyl group is 4.5 mmol/g or more, superiority of the flame-retarding property to other existing flame-retarding materials is significant whereby there are many cases where a preferred result is achieved.

With regard to the rate of the magnesium-type salt in the salt-type carboxylic group, although there is no particular limitation so far as the aimed high flame-retarding property is able to be achieved, it is preferred that the amount is as much as possible for achieving a higher flame-retarding property. On the contrary, residual salt-type carboxyl group other than the magnesium salt type works in the direction of lowering the flame-retarding property and, therefore, it is preferred that the amount thereof is as little as possible. In order to achieve the practically high flame-retarding property, it is preferred that, among the salt-type carboxyl group, not less than 70% is a magnesium salt type and, in the cases, for example, when amount of the carboxyl group itself in the fiber is small, it is preferred that not less than 80% is a magnesium salt type.

The weight rate of the amount of magnesium in the fiber is determined by amount of carboxyl group of magnesium type and, there is no particular limitation so far as the high flame-retarding property which is the object of the present invention is able to be achieved. However, due to the fact that the more the magnesium amount, the higher the flame-retarding property, it is preferred that magnesium in an amount of as much as possible is contained therein. Particularly in the present invention, it has been found that, when magnesium in amount of more than a predetermined level is contained, the flame-retarding property suddenly increases and, therefore, it is preferred that magnesium is contained in a higher amount than said level. To be more specific, with regard to the level, not less than 4% by weight is preferred and, when it is not less than 5% by weight, a very high flame-retarding property is able to be achieved and that is particularly preferred.

There is no particular limitation for a method for introduction of salt-type carboxyl group into the fiber and its examples are a method where a polymer containing a salt-type carboxyl group is made into fiber (method 1), a method where a polymer having carboxyl group is made into fiber and then said carboxyl group is made into a salt type (method 2), a method where a polymer having a function group which is able to be induced to carboxyl group is made into fiber and said functional group in the resulting fiber is converted to carboxyl group by means of chemical modification and further converted to a salt type (method 3) and a method where salt-type carboxyl group is introduced into the fiber by means of graft polymerization.

Example of a method to prepare a polymer having salt-type carboxyl group of the above-mentioned method 1 are methods in which a salt-type monomer corresponding to a monomer containing a carboxyl group such as acrylic acid, methacrylic acid, maleic acid, itaconic acid or vinyl propionic acid is polymerized either solely or jointly using two or more of those monomers or in a form of a mixture of a carboxylic acid type with a corresponding salt type which are the same species or with other monomer which is able to be copolymerized with those monomers, and methods in which a monomer containing a carboxyl group is polymerized, followed by converting into a salt type.

Examples of the method 2 where a polymer having carboxyl group is made into fiber and then converted to a salt type are methods in which a homopolymer of an acid-type monomer containing carboxyl group as mentioned above, a copolymer comprising two or more said monomers or a copolymer with other copolymerizable monomer is made into fiber and then converted into a salt type. There is no particular limitation for converting the carboxyl group into a salt type and, conversion is able to be conducted by, for example, a method where a solution containing the above-mentioned cation including, at least, magnesium is made to act to the resulting fiber having the above-mentioned acid-type carboxyl group to conduct an ion exchanging.

Examples of the method 3 where carboxyl group is introduced by means of a chemical modification method are methods in which a homopolymer of a monomer having a functional group which is able to be converted to carboxyl group by a chemical modification treatment, a copolymer comprising two or more said monomers or a copolymer with other copolymerizable monomer is made into fiber and the resulting fiber is hydrolyzed so that chemical modification to carboxyl group is conducted. When the carboxyl group prepared by said hydrolysis is obtained in a desired salt type, it functions as a salt-type carboxyl group as it is. On the other hand, when the state which is obtained by acid hydrolysis, etc. is not a salt type or is not a desired salt type, a method where the carboxyl group which was modified is converted to a desire salt type by the above method is applied upon necessity.

With regard to a monomer which is able to adopt the method 3 and has a functional group which is able to be converted to carboxyl group by a chemical modification treatment, there is no particular limitation and its examples are a monomer having nitrile group such as acrylonitrile and methacrylonitrile and anhydride, ester derivative, amide derivative, ester derivative having a cross-linking property, etc. of a monomer having carboxylic acid group such as acrylic acid, methacrylic acid, maleic acid, itaconic acid and vinylpropionic acid.

Specific examples of anhydride of the monomer having carboxyl acid group are maleic acid anhydride, acrylic acid anhydride, methacrylic acid anhydride, itaconic acid anhydride, phthalic acid anhydride, N-phenylmaleimide and N-cyclomaleimide.

Examples of the ester derivative of the monomer having carboxyl acid group are alkyl ester derivatives such as methyl, ethyl, propyl, butyl, pentyl, hexyl, heptyl, octyl, lauryl, pentadecyl, cetyl, stearyl, behenyl, 2-ethylhexyl, isodecyl and isoamyl; alkyl ether ester derivatives such as methoxyethylene glycol, ethoxyethylene glycol, methoxypolyethylene glycol, ethoxypolyethylene glycol, polyethylene glycol, methoxypropylene glycol, propylene glycol, methoxypolypropylene glycol, polypropylene glycol, methoxypolytetraethylene glycol, polytetraethylene glycol, polyethylene glycol-polypropylene glycol, polyethylene glycol-polytetraethylene glycol, polypropylene glycol-polytetraethylene glycol and butoxyethyl; cyclic compound ester derivatives such as cyclohexyl, tetrahyrofurfuryl, benzyl, phenoxyethyl, phenoxypolyethylene glycol, isobornyl and neopentyl glycol benzoate; hydroxyalkyl ester derivatives such as hydroxyethyl, hydroxypropyl, hydroxybutyl, hydroxyphenoxypropyl, hydroxypropylphthaloylethyl and chlorohydroxypropyl; aminoalkyl ester derivatives such as dimethylaminoethyl, diethylaminoethyl and trimethylaminoethyl; alkyl carboxylate derivatives such as (meth)acryloyloxyethyl succinate and (meth)acryloyloxyethyl hexahydrophthalate; alkyl ester derivatives containing phosphoric acid group or phosphate group such as (meth)acryloyloxyethyl acid phosphate; cross-linking alkyl esters such as ethylene glycol di(meth)acrylate, polyethylene glycol di(meth)acrylate, 1,4-butanediol di(meth)acrylate, 1,3-butanediol di(meth)acrylate, 1,6-hexanediol (meth)acrylate, 1,9-nonanediol di(meth)acrylate, trimethylolpropane tri(meth)acrylate, pentaerythritol tetra (meth)acrylate, dipentaerythritol hexa(meth)acrylate, glycerol dimethacrylate, 2-hydroxy-3-acryloyloxypropyl (meth) acrylate, bisphenol A ethylene oxide adduct di(meth)acrylate, bisphenol A propylene oxide adduct di(meth)acrylate, neopentyl glycol di(meth)acrylate, 1,10-deccanediol di(meth) acrylate, dimethylol tricyclodecane di(meth)acrylate and ethylene oxide-modified trimethylolpropane tri(meth)acrylate; and fluorinated alkyl ester derivatives such as trifluoroethyl, tetrafluoropropyl, hexafluorobutyl and perfluorooctylethyl.

Examples of the amide derivative of the monomer having carboxyl acid group are amide compounds such as (meth) acrylamide, dimethyl (meth)acrylamide, monoethyl (meth) acrylamide and n-tert-butyl (meth)acrylamide. As to other methods for introducing carboxyl group by chemical modification, oxidation of alkene, halogenated alcohol, alcohol, aldehyde, etc. may be also listed.

There is no particular limitation for a method of hydrolysis for introduction of salt-type carboxyl group in the method 3 but common methods may be applied. Examples thereof are a method where the above-mentioned monomer is polymerized, the resulting polymer is made into fiber and hydrolyzed using an aqueous solution of a basic compound such as alkali metal hydroxide (e.g., sodium hydroxide, lithium hydroxide or potassium hydroxide), alkali earth metal hydroxide, alkali metal carbonate and ammonia to introduce a salt-type carboxyl group and a method where carboxylic acid group is prepared by the reaction with mineral acid such as nitric acid, sulfuric acid and hydrochloric acid or an organic acid such as formic acid and acetic acid, mixing with the above-mentioned salt-forming compound and subjecting to ion exchange to introduce a salt-type carboxyl group. Although there is no particular limitation for the condition of a method for the hydrolyzing treatment, the means where the treatment is conducted in an aqueous solution of 1 to 40% by weight or, more preferably, 1 to 20% by weight of the basic or acidic compound for conducting the hydrolysis at the temperature of 50 to 120° C. for 1 to 30 hour(s) is preferred in view of industry and fiber properties.

With regard to the introduction of magnesium which is an essential metal of the present invention, it is able to be achieved by dipping the above-prepared polymer containing a salt-type carboxyl group into an aqueous solution containing magnesium ion such as an aqueous solution of magnesium nitrate. In order to achieve a high flame-retarding property which is an object of the present invention, it is preferred to introduce magnesium in an amount of as much as possible.

An example of a method by which carboxyl group of a magnesium salt type is introduced in large amount and in a sure manner is a method where hydrolysis with a hydroxide of univalent light metal such as lithium, sodium and potassium is conducted to give the carboxyl group of the corresponding salt type followed by dipping into an aqueous solution containing magnesium ion such as an aqueous solution of magnesium nitrate to introduce a carboxyl group of a magnesium salt type.

Another method is that, firstly, fiber after the hydrolysis is dipped into an aqueous solution of acid such as nitric acid so that all of carboxyl groups in the polymer are converted into carboxyl groups of H type. After that, the resulting polymer is dipped into an alkaline aqueous solution containing univalent light metal ion such as aqueous solution of sodium hydroxide, aqueous solution of potassium hydroxide or aqueous solution of lithium hydroxide so that the H-type carboxyl group is converted into a carboxyl group of a light metal salt type. At that time, it is better to set the pH as high as possible so that exchange to Na type is able to be done completely. When the pH is set at not lower than 10 or, more preferably, at not lower than 12, it is possible to prepare a highly converted carboxyl group of a univalent light metal type. After that, it is dipped into an aqueous solution containing magnesium ion such as aqueous solution of magnesium nitrate whereupon carboxyl group of a magnesium salt type is able to be introduced.

Here, the carboxyl group converted into carboxyl group of magnesium salt type is carboxyl group of univalent light metal type, and carboxyl group of H type is hardly converted into carboxyl group of magnesium salt type. Thus, if carboxyl group of H type exists when performing magnesium exchange, magnesium exchange does not occur and there is a possibility that carboxyl group of H type remains in the fiber.

One of the reasons why achievement of a very highly flame-retarding property is possible according to the present invention is that the fact where functional groups other than a carboxyl group of a magnesium salt type which result in lowering of flame-retarding property are made as little as possible effectively works and that is one of the important characteristics constituting the present invention. Accordingly, during the above-mentioned steps such as hydrolysis and conversion into magnesium salt type, although there is a possibility that functional groups other than the magnesium salt-type carboxyl group remain as a result or are introduced by the reaction, it is preferred for achieving the high flame-retarding property of the present invention that functional groups other than the magnesium salt-type carboxyl group are made as little as possible.

Here, with regard to the functional groups other than a magnesium salt-type carboxyl group which remain as a result or are introduced by the reaction, examples thereof are anhydrous ester group, ester group, nitrile group and amide group which do not react during the reaction being remained as a result; amide group, etc. which are intermediates upon conversion from nitrile group into carboxyl group; carboxylic acid group (carboxyl group of an H type) which is produced by modification with an acid during the conversion to a magnesium type and is not converted to a magnesium type; and carboxyl group of a salt type other than magnesium which is produced by hydrolysis or produced during the conversion to a magnesium type and is not converted into a magnesium type.

Although there is no particular limitation for the amount of the carboxyl groups in a salt type which is other than magnesium, it is preferred to be as small as possible so that the flame-retarding property is much more enhanced.

To be more specific, in order to achieve the practically high flame-retarding property, it is preferred that the total amount of each of the carboxyl groups in the salt type which is other than magnesium to the amount of the magnesium salt-type carboxyl group is not more than 40 mol %. If a very high flame-retarding property is necessary, not more than 30 mol % is particularly preferred.

Further, particularly when anhydrous ester group, ester group, nitrile group, amide group, nitrile group, carboxylic acid group, etc. which are not in a salt form remain, there is a significant lowering in the flame-retarding property and, therefore, it is preferred that amount of such functional groups is made to such an extent that it is not substantially recognizable by conducting such means that, for example, the reaction is made completely finished. To be more specific, amount of the functional groups is preferably less than 1 mmol/g and, more preferably, less than 0.1 mmol/g.

On the other hand, as to carboxyl group of univalent light metal type such as sodium, potassium and lithium, lowering in the flame-retarding property is not so remarkable as in the above-mentioned functional group of a non-salt type but there is a tendency that burning without flame happens and fire flushes and spreads out and that is not preferred. Accordingly, it is preferred that amount of such a functional group is also as small as possible. To be more specific, amount of the functional group is preferably less than 2 mmol/g and, more preferably, less than 0.5 mmol/g.

In the highly flame-retarding and moisture-absorptive fiber of the present invention, it is necessary to have a cross-linking structure in addition to the above-mentioned carboxyl group of a magnesium type. With regard to the cross-linking structure in the present invention, there is no particular limitation so far as the demanded fiber property or the high flame-retarding property which is a characteristic feature of the present invention is not physically or chemically denatured upon moisture absorption and desorption. Thus, it may be in any structure such as cross-linking by covalent bond, ionic cross-linking and cross-linking by interaction among polymer molecules or crystal structure. There is also no particular limitation for a method of introducing the cross-linking and there may used a commonly used method such as introduction of chemical post-cross-linking after or during formation of fibrous shape and introduction of post-cross-linking structure by physical energy after formation of fibrous shape. Among them, in the method where a post-cross-linking is chemically introduced after formation of fibrous shape, it is possible to introduce a strong cross-linking by covalent bond efficiently and highly, giving a preferred result.

With regard to the method where a post-cross-linking is chemically introduced during the formation of fibrous shape, an example thereof is a method where a polymer forming the fiber is spun by mixing with a cross-linking agent having in a molecule two or more functional groups chemically bonding to a functional group in the polymer and then subjected to a cross-linking by heat or the like. In this method, a cross-linking structure is formed utilizing a polymer having carboxyl group and/or salt-type carboxyl group and said functional group or other functional group in said polymer whereupon a fiber having a salt-type carboxyl group and cross-linking structure is able to be prepared. On the other hand, when a method where a cross-linking structure is introduced by a hydrazine compound which will be mentioned later is used, it is possible to obtain a fiber having a salt-type carboxyl group and a cross-linking structure when the nitrile group which did not participate in the cross-linking is hydrolyzed.

With regard to a method for introducing the post-cross-linking by a chemical means after formation of the fibrous shape, there is no particular limitation for its condition, etc. and an example thereof is a post-cross-linking method where nitrile group contained by an acrylonitrile fiber comprising not less than 50% by weight of vinyl monomer having nitrile group is made to react with a hydrazine compound or formaldehyde. Among the above, a method using a hydrazine compound is very good in such a respect that the structure is stable to acid and alkali and the cross-linking structure itself is able to contribute in improvement of a flame-retarding property and further that a strong cross-linking by which a fiber characteristic which is demanded for processing, etc. is able to be achieved is able to be introduced. Incidentally, with regard to the cross-linking structure prepared by said reaction, the structure is presumed to be based on a triazole ring or tetrazole ring structure although the details have not been identified yet.

With regard to the vinyl monomer having the nitrile group used here, there is no particular limitation so far as it has nitrile group and specific examples thereof are acrylonitrile, methacrylonitrile, ethacrylonitrile, α-chloroacrylonitrile, α-fluoroacrylonitrile and vinylidene cyanide. Among them, acrylonitrile which is advantageous in view of cost and has much nitrile amount per unit weight is most preferred.

With regard to a method where cross-link is introduced by the reaction with a hydrazine compound, there is no particular limitation of condition so far as the aimed cross-linking structure is prepared and concentrations of the acrylonitrile polymer and the hydrazine compound upon the reaction, solvent used therefore, reaction time and reaction temperature, etc. may be appropriately selected upon necessity. With respect to the reaction temperature among the above, reaction rate becomes slow and reaction time becomes too long when it is too low while, when it is too high, problems that plasticization of the material acrylonitrile fiber takes place and that the form is destroyed may be resulted. Accordingly, the temperature is preferably 50 to 150° C. and, more preferably, 80° C. to 120° C.

With regard to the part of the acrylonitrile fiber which is to be made to react with the hydrazine compound, there is also no particular limitation but it may be appropriately selected from such modes that the reaction is applied to the surface of said fiber only or to the core as a whole and the reaction is conducted by limiting the specific part. Examples of the hydrazine compound used here are hydrazine and salts thereof such as hydrazine hydrate, hydrazine sulfate, hydrazine hydrochloride, hydrazine nitrate, hydrazine hydrobromide and hydrazine carbonate and hydrazine derivative and salt thereof such as ethylenediamine, guanidine, guanidine sulfate, guanidine hydrochloride, guanidine nitrate, guanidine phosphate and melamine.

When the cross-linking structure of the highly flame-retarding and moisture-absorptive fiber of the present invention is introduced by the reaction with a hydrazine compound, it is also acceptable to use an acrylonitryl fiber which is subjected to a treatment other than the above-mentioned acid treatment, hydrolyzing treatment, ion-exchanging treatment after hydrolysis and pH-adjusting treatment mentioned hereinabove already for the introduction of the magnesium-type carboxyl group. With regard to the acrylonitrile fiber which is to be made to react with a hydrazine compound, that which is kneaded with titanium oxide, carbon black, etc. or which is stained with dye may be used as well.

It is necessary that the highly flame-retarding and moisture-absorptive fiber of the present invention has such an excellent moisture-absorbing property that a saturated moisture absorption rate at 20° C. and 65% relative humidity is not less than 35% by weight. When the moisture-absorbing property is high, there is a tendency that a property of accumulating the moisture in the fiber is high and, as a result, an effect of enhancing the flame-retarding property is also available. When it is used for the use such as clothing and bedroom things, it is possible to give a function such as a dry feeling due to the high moisture-absorptive property and moisture-absorptive heat generation property and it is also possible to enhance the functionality. When the value of the saturated moisture absorption rate is less than 35% by weight, a moisture-absorbing property as the basic property becomes low whereby the aforementioned characteristics are unable to be available and an object of the present invention is unable to be achieved. Incidentally, the saturated moisture absorption rate used here means the value that, after the sample is absolutely dried, it is allowed to stand under predetermined temperature and humidity until the saturated state where said material shows no change in weight is achieved and then the moisture-absorptive amount is determined from the changes in the weight before and after the above and is divided by the absolutely dried weight of the starting sample.

The highly flame-retarding and moisture-absorptive fiber of the present invention also has a use where it is repeatedly used as fiber and fiber structure and, therefore, it is preferred that the high moisture-absorptive property is reversible and also has a moisture-desorptive property at the same time and that changes in volume and changes in shape as a result of the moisture absorption and desorption are as little as possible.

The highly flame-retarding and moisture-absorptive fiber of the present invention has a high moisture-absorptive property and has a high hydrophilic characteristic. However, in order to maintain the shape and the processing characteristic as fiber, it is preferred that the water-absorbing ability thereof is not too high and that the swelling thereof is not too much. To be more specific, preferred water absorbing multiplication factor is preferably not more than two-fold and, more preferably, not more than 1.3-fold. The water absorbing multiplication factor used here is the value that the sample in an absolutely dried state is dipped into water, water is absorbed therewith until the saturated state and amount of absorbed water is determined from the changes in the weight before and after that and is divided by the weight of the sample in the absolutely dried state. With regard to the fiber length, when its difference between dried state and state of water absorption is too big, that affects the form of the fiber structure upon washing and drying and such a thing is not preferred. With regard to the variation rate which is expressed by dividing the difference between fiber length upon drying and that upon water absorption by fiber length upon drying, it is preferred to be as small as possible and, to be more specific, good result is often available when it is not more than 30%.

Since the highly flame-retarding and moisture-absorptive fiber of the present invention is to have a high flame-retarding property, it is necessary that its limiting oxygen index (LOI) is not less than 35. When the value is less than 35, that is insufficient as the flame-retarding characteristic and an object of the present invention is unable to be achieved. The LOI is that the volume of oxygen necessary for maintaining the burning is made into an index in terms of volume fraction and is also an index showing the degree of a flame-retarding property. Accordingly, when the value is higher, the flame-retarding property is higher. When the value is 27 or more, there is achieved a self-extinguishing property for fire where fire is extinguished by itself when a heat source disappears.

Although there is no particular limitation for the burning form, it is preferred in view of flame prevention to have characteristics such as that flame does not spread and no dropping substance is generated by burning. To be more specific, it is preferred to be in a level of "94V-0" according to the UL Standard. The UL Standard is a standard concerning the burning property of plastics where grade of a flame-retarding property is decided by such a fact that, when a sample is burned by a burner and then a heat source for the burner is removed, how many second is needed until the fire of the sample is extinguished. The "94V-0" is defined that time for the fire extinguishing is 10 seconds at the longest and not longer than 5 seconds in average and that is a level where the degree of flame retardation is best.

With regard to the fuming property upon burning, fuming smoke concentration is preferred to be as low as possible and, to be more specific, light transmission rate Ds of the fuming smoke concentration is preferred to be not more than 10.

Noxious gases generated upon burning such as carbon monoxide, cyanic acid gas and $NO_x$ are also preferred to be as little as possible.

With regard to the shape-holding property by burning, it is also preferred that no melting takes place by burning or by heat upon burning and that the original shape is retained even if burning takes place. For example, even when a lit cigarette is placed on a structure comprising the fiber of the present invention, it is preferred that no change in the form such as shrinking takes place and no fire spreads thereto.

With regard to the fiber properties of the highly flame-retarding and moisture-absorptive fiber of the present invention, there is also no particular limitation so far as they practically satisfy the object of the present invention. However, the property resisting to processing, etc. for making into the structure is at least necessary. To be more specific, tensile tenacity, tensile elongation and knot tenacity are preferred to be not less than 0.05 cN/dtex, not less than 5% and not less than 0.01 cN/dtex, respectively. With regard to the fiber length, it may be also appropriately set depending upon the use.

With regard to the specific gravity of the highly flame-retarding and moisture-absorptive fiber of the present invention, there is also no particular limitation so far as it is able to satisfy the characteristics of the object of the present invention such as a flame-retarding property. However, in the use applied as fiber, there are many cases where the specific gravity is preferred to be small in view of such a respect that the fiber does not become heavy or in view of mixing with other fiber and, to be more specific, not more than 1.8 g/cm$^3$ is preferred. With this respect, magnesium is a light metal having a light specific gravity and is divalent whereby many magnesium-type carboxyl groups are able to be introduced in small amount and, as compared with other metal, magnesium is able to prepare fiber having less specific gravity. Probably due to such a reason, a high flame-retarding property is achieved even if the amount per weight of the fiber is relatively small as compared with other metal and that is also one of the characteristic features of the present invention.

Since the highly flame-retarding and moisture-absorptive fiber of the present invention is used in the use where a high flame-retarding property is required, there are many cases where a thermally stable characteristic is demanded and it is preferred that a tensile tenacity-retaining rate after 180° C. for 1,000 hours is not less than 80% or that a shrinking rate under no tension after 300° C. for 30 minutes is not more than 20%.

With regard to the fiber structure of the present invention, there are forms of thread, yarn (including wrapped yarn), filament, textile, knitted thing, nonwoven fabric, paper-like product, sheet-like product, layered product and cotton-like product (including that in spheres and lumps) and, further, there is a product where cover is applied thereto. With regard to the form of the highly flame-retarding and moisture-absorptive fiber of the present invention contained therein, its examples are that which is substantially uniformly distributed by mixing with other materials and that, in the case of a structure having plural layers, it may be present in a concentrated manner in any layer(s) (that may be either singular or plural) or it may be distributed in each layer in a specific ratio. Accordingly, with regard to the fiber structure of the present invention, there are numerous products as a combination of the above-exemplified forms and contained forms. Decision for what structure is to be prepared is appropriately done by taking the contribution of the fiber of the present invention depending upon the use mode of the final product demanded to the actually used use of the fiber of the present invention into consideration.

When the structure is checked in detail, it comprises the highly flame-retarding and moisture-absorptive fiber of the present invention either solely or just together with other material in a nearly homogeneously mixed state or it is in a layered form in two to five layers where other material is layered or laminated by means of being stuck, adhered, fused, sandwiched, etc. There is also another product where, although it is layered, no positive conjugation is conducted but the layered state is maintained by a support.

The use of the final product where the fiber structure of the present invention is utilized may be roughly classified into that which is utilized being put on by human; bedroom things such as bedclothes, pillow and cushion; interiors represented by curtain and carpet; and those used in a industrial material field such as for automobiles, vehicles, airplanes, electric instruments, electric/electronic parts, building materials, agricultural materials and constructing materials. Depending upon the use as such, the optimum structure is able to be selected from single to plural layer(s) together, if necessary, with a cover therefore so as to satisfy the demanded functions.

It is necessary that the fiber structure of the present invention contains the highly flame-retarding and moisture-absorptive fiber of the present invention and there is no particular limitation for the amount of said fiber but the amount may be selected by taking the function necessary for the use into consideration. Practically however, when the amount of the highly flame-retarding and moisture-absorptive fiber of the present invention becomes too low, there are some cases where the aimed function is hardly available and, to be more specific, the amount is preferred to be not less than 5% and, practically, it is more preferred to be not less than 10%. When the amount of the highly flame-retarding and moisture-absorptive fiber of the present invention is 100%, it goes without saying that the product has the best property in terms of flame-retarding property and moisture-absorptive property. With regard to the flame-retarding property of the structure comprising the fiber of the present invention, there is no particular limitation so far as the flame-retarding property depending upon the actual use is able to be achieved. Practically however, it is preferred to have a flame-retarding property which is not less than the self-incombustibility and to have an LOI value of not less than 28. Accordingly, amount of the fiber of the present invention is also preferred to be set in such a manner that not less than 28 of LOI value is able to be achieved.

With regard to other material which is able to be mixed with the highly flame-retarding and moisture-absorptive fiber of the present invention, there is no particular limitation but it is able to be appropriately selected. Examples thereof are natural fiber, synthetic fiber, semi-synthetic fiber, pulp, inorganic fiber, rubber, resin, plastic and film. With regard to the flame-retarding property of the material which is able to be mixed, there is also no particular limitation although it is preferred in achieving higher flame-retarding property to mix with flame-retardant material such as flame-retardant fiber, flame-retardant resin, flame-retardant plastic, flame-retardant rubber and inorganic fiber. With regard to a method for achieving the flame-retarding property to such a material, there is no particular limitation and an organic compound such as phosphate type, halogen-containing phosphate type, condensed phosphate type, polyphosphate type, red phosphorus type, chlorine type, bromine type, guanidine type and melamine type and inorganic one such as antimony trioxide, magnesium hydroxide and aluminum hydroxide may be exemplified. However, in terms of safety and in view of affection to environment, a compound which is not noxious such as guanidine and melamine compounds or magnesium hydroxide, aluminum hydroxide, etc. is preferred.

The highly flame-retarding and moisture-absorptive fiber of the present invention is preferred to have antibacterial property and/or antifungal property or a deodorizing property as functions other than flame-retarding and moisture-absorptive properties. As mentioned already, with regard to the use of the present invention, the use by being put on by human is also often and, when antibacterial property and/or antifungal property or deodorizing property are/is applied, a product which is good in view of hygiene is prepared and there is an advantage that the problem of generation of dust and nasty smell due to generation of bacteria or fungi can be prevented. In order to enhance such a characteristic, it is also possible to further use commonly-used organic and inorganic antibacterial agents.

With regard to deodorizing property, there are many fields where deodorizing property is demanded in the use for bedroom things such as bedclothes, pillow and cushion; interiors represented by curtain and carpet; and industrial material field such as for automobiles, vehicles, airplanes, electric instruments, electric/electronic parts, building materials, agricultural materials and constructing materials and it is preferred to have deodorizing property as the function of the fiber of the present invention. When a deodorizing property is also available, a function is further bestowed and it is now possible to use for a deodorizing use as well.

With regard to other function, it is preferred to have an electrostatic property. In the use where a flame-retarding material is used, spark of static electricity may be a trigger for fire, explosion, etc. and, therefore, there are many cases where an electrostatic property by which static electricity is prevented is demanded for a flame-retarding use in which fire or the like is supposed. With regard to the electrostatic level, it is preferred that a friction electrical strength or half life in a material where 30% by weight of the fiber of the present invention is mixed are less than 2,000 V or shorter than 1.0 second, respectively.

EXAMPLES

The present invention will now be more specifically illustrated by way of the following Examples although the present invention is not limited by the following Examples. The terms "part(s)" and "%" in the Examples are those by weight unless otherwise mentioned. Firstly, method for evaluation of each characteristic and method for representation of the evaluation result will be explained.

Amount of total carboxyl group (mmol/g):

A well-dried sample fiber (about 1 g) was precisely weighted [X (g)], 200 ml of 1N aqueous solution of hydrochloric acid was added thereto and the mixture was allowed to stand for 30 minutes, filtered through a glass filter and washed with water after addition of water. The treatment with hydrochloric acid was repeated for three times and well washed with water until pH of the filtrate became 5 or higher. After that, this sample was placed in 200 ml of water, the mixture was adjusted to pH 2 by addition of 1N aqueous solution of hydrochloric acid thereto and a titration curve was determined by a common method using a 0.1N aqueous solution of sodium hydroxide. From said titration curve, amount [Y ($cm^3$)] of the aqueous solution of sodium hydroxide consumed by carboxyl group was determined and the total carboxyl group amount was calculated by the following formula.

$$\text{Total carboxyl group amount (mmol/g)}=0.1Y/X$$

Amount of carboxyl group of salt type (mmol/g),

Rate of carboxyl of salt type (mol %) and Content of magnesium (%):

A well-dried sample fiber was precisely weighed, subjected to an acid decomposition by a common method using a mixed solution of concentrated sulfuric acid and concentrated nitric acid and metal contained in a form of a salt of carboxyl group was quantified by an atomic absorption spectroscopy by a common method and divided by atomic weight of said metal to calculate an amount of salt-type carboxyl group. The "salt-type carboxyl group amount" was divided by the above "total carboxyl group amount" and expressed in terms of a molar fraction to determine the rate of the salt-type carboxyl.

Magnesium was quantified by an atomic absorption spectroscopy using the same method as above and amount of magnesium per fiber weight was expressed as percent by weight.

Saturated moisture absorption rate (%) and saturated moisture absorption rate at low-humidity (%):

A sample fiber (about 5.0 g) was dried using a hot-air drier at 105° C. for 16 hours to measure its weight [W1 (g)]. After that, the sample was placed in a chamber of constant temperature and constant humidity kept at 20° C. temperature and 65% relative humidity for 24 hours. Weight [W2 (g)] of the sample moisturized as such was measured. From the above results, moisture absorption rate was calculated by the following formula.

$$\text{Saturated moisture absorption rate (\%)}=(W2-W1)/W1*100$$

A saturated moisture absorption rate at low-humidity was calculated by the same method as above except that the sample was placed in a machine of constant temperature and constant humidity kept at 20° C. temperature and 40% relatively humidity for 24 hours.

Water Absorbing Multiplication Factor(−Fold):

A sample fiber (5 g) was dipped into pure water, allowed to stand at 30±5° C. for 3 hours and subjected to a dehydrating treatment using a centrifugal dehydrating machine at the revolution of 1,000 G for 3 minutes. Weight [W3 (g)] of the sample dehydrated as such was measured. After that, said sample was dried in a hot-air drying machine of 105° C. until it was absolutely dried, the weight [W4 (g)] of such a sample was measured and a water absorbing multiplication factor(−fold) was calculated by the following formula.

$$\text{Water absorbing multiplication factor(−fold)}=(W3-W4)/W4$$

Limiting Oxygen Index (LOI): This was measured in accordance with the measuring method of JIS K 7201-2. When this value is big, a flame-retarding property is high.

UL Standard: This was measured in accordance with UL-94 "Test Method of Vertical Combustion" in the Standard for UL (UNDERWRITER Laboratories Inc.) Flame-Resistant Test. It is expressed as V-0>V-1>V-2 in the order of a higher flame retardant property.

Fuming property: This was conducted in accordance with ASTM E-662 where fuming smoke concentration was measured as a light transmission rate (Ds) and quantified. When this value is smaller, fuming property is lower.

Fusing and hole-burning properties: A lit cigarette was placed on a nonwoven fabric made of the fiber to be measured and the situation was observed until the cigarette was completely burned out. After burning of the cigarette, surface of said nonwoven fabric was checked and the fused state and the state whether hole was made by burning were confirmed.

Tensile Tenacity Of Fiber (cN/dtex),

Tensile elongation of fiber (%) and Knot tenacity of fiber (cN/dtex):

For the above fiber properties, evaluation was carried out in accordance with JIS L 1015.

Retention rate of hot-air tensile tenacity (%):

This was evaluated in accordance with JIS L 1095.

Hot-air shrinking rate (%):

A spun yarn comprising the fiber to be measured was used, allowed to stand at 200° C. for 30 minutes under a non-tension state and the change in fiber length before and after measurement was divided by the fiber length before the measurement and expressed in terms of percent.

Specific gravity (g/cm$^3$) of fiber: This was evaluated in accordance with JIS L 1013 (sink-float method).

Deodorizing ability: Deodorizing rate (%) for smelling substance

Fiber to be measured (2 g) was placed in a Tedlar bag and tightly sealed and 3 liters of air was infused therein. After that, a smelling substance in an initial concentration (W5) set for each smelling substance was placed in a Tedlar bag and allowed to stand at room temperature for 120 minutes and concentration (W6) of said smelling substance in the Tedlar bag was measured by a Kitagawa's detecting tube. In the meanwhile, a smelling substance in the initial concentration set for each smelling substance was placed in a Tedlar bag into which no sample was placed and, after 120 minutes, concentration (W7) of the smelling substance was measured and that was used as a control test. From the above results, deodorizing rate for the smelling substance was calculated by the following formula.

$$\text{Deodorizing rate (\%) for the smelling substance} = (W5-W6)/W7*100$$

Here, the measured smelling substances and initial concentrations set therefore were ammonia (10 ppm), acetaldehyde (30 ppm), acetic acid (50 ppm) and hydrogen sulfide (10 ppm).

Antibacterial property:

Nonwoven fabric was used and bacteriostatic activity value and bactericidal activity value were measured in accordance with JIS L 1902 "Bacterial solution absorption method". Bacteria strain used for the antibacterial test were *Escherichia coli* NBRC 3972 and *Pseudomonas aeruginosa* NBRC 3080. When the value is larger, the antibacterial property is higher.

Antistatic property: Friction electrical strength and half life were measured in accordance with JIS L 1094 "Electrostatic Test Method for Textile and Woven Thing".

Example 1

An original solution for spinning where an acrylonitrile type polymer comprising 90% of acrylonitrile and 10% of methyl acrylate was dissolved in 48% aqueous solution of sodium thiocyanate was prepared and subjected to spinning, washing with water, elongation, crimp and thermal treatment by a conventional method to give a material fiber of 0.9 (dtex)×70 (mm). To this material fiber (1 kg) was added 5 kg of 30% by weight of hydrazine hydrate and a cross-linking treatment was carried out therefore at 98° C. for 3 hours. Said cross-linked fiber was washed with water and 9 kg of 3% by weight of sodium hydroxide was added thereto followed by hydrolyzing at 92° C. for 5 hours. After that, it was treated with 1N aqueous solution of $HNO_3$ to convert carboxyl group into H type and washed with water and pH was adjusted to 12 with 1N NaOH followed by washing with water to give a fiber having carboxyl group of a sodium salt type. After that, 8 kg of 10% aqueous solution of magnesium nitrate was added, a converting treatment into a magnesium salt type was conducted at 60° C. for 2 hours and the mixture was well washed with water, dehydrated and subjected to treatment with oil and to drying to give the highly flame-retarding and moisture-absorptive fiber of the present invention.

Result of the evaluation of the resulting fiber is as shown in Table 1 and it was confirmed that the flame-retarding property was as high as 38.5 LOI value and that the saturated moisture absorption rate was as high as 41%. When amount of carboxyl group of the resulting fiber was measured, total carboxyl group amount was 6.6 mmol/g and 5.7 mmol/g which was 87 mol % thereof was carboxyl group of magnesium type whereby amount of magnesium was 6.9% of the fiber weight having a sufficient magnesium amount.

Other characteristics of this fiber were also measured. With regard to the moisture-desorptive property, a saturated moisture absorption rate at low-humidity at 20° C. and 40% relative humidity was 19% and it was lower to an extent of more than 20% as compared with 41% which was the saturated moisture absorption rate at 20° C. and 65% relative humidity whereby an excellent moisture-desorptive ability was noted. In the measurement of the saturated moisture-absorption rate as such, no change in the fiber form was noted. With regard to the characteristic upon water absorption, the water absorbing multiplication factor was measured to be 1.1-fold and variation rate in the difference between fiber length upon drying and fiber length upon water absorption at that time was 18% whereby that is in a level which does not matter in the processing of the structure, etc.

With regard to the flame-retarding and burning properties other than LOI, nonwoven fabric having basis weight of 200 g/m$^2$ was prepared solely from the resulted fiber and its characteristics were evaluated. The result was that, in the evaluation according to the UL standard, even when flame was allowed to come near and burning was conducted, retention of the flame was 0 second and no dropping thing was generated whereby the a burning characteristic was so good that the judged rank was V-0. Evaluations were also conducted for fusing and hole-burning properties and, in the case of light of cigarette, neither fusion nor hole burning was noted whereby excellent flame-retarding property and flame-preventing properties were noted. Further, value of fuming property upon burning was 1% and it was very low as compared with the fuming concentration of 40 to 50 where smoke was usually noted whereby fuming was hardly available.

Properties of the resulting fiber were that tensile tenacity was 1.5 cN/dtex, tensile elongation was 15% and knot tenacity was 1.0 cN/dtex whereby sufficient fiber properties for the processing were available. Further, retention rate of hot-air tensile tenacity at 180° C. was 118% and hot-air shrinking rate was 1.5% whereby the fiber had excellent thermal stability as well. Specific gravity of said fiber was 1.53 g/cm$^3$ and the fiber had a property which caused no problem in the processing of fiber as well.

The result of evaluation of deodorizing ability of the fiber prepared in Example 1 was that removing rate for ammonia was 90%, removing rate for acetaldehyde was 85%, removing rate for acetic acid was 87% and removing rate for hydrogen sulfide was 68% whereby a deodorizing effect was noted for all of the smelling substances. With regard to the antibacterial property, 200 g of nonwoven fabric prepared solely from said fiber was tested and the result was that bacteriostatic activity value and bactericidal activity value for *Escherichia coli* were not less than 4.7 and not less than 1.4, respectively and that bacteriostatic activity value and bactericidal activity value for *Pseudomonas aeruginosa* were not less than 4.4 and not less than 1.6, respectively showing excellent antibacterial properties in all cases.

TABLE 1

| | Ex 1 | Ex 2 | Ex 3 | Ex 4 | Ex 5 | Comp Ex 1 | Comp Ex 2 | Comp Ex 3 |
|---|---|---|---|---|---|---|---|---|
| Amt of carboxyl group of Mg-salt type (mmol/g) | 5.7 | 6.3 | 4.9 | 3.7 | 7.2 | 3.8 | 2.9 | 9.1 |
| Rate of carboxyl group of Mg-salt type (mol %) | 87 | 93 | 72 | 96 | 92 | 56 | 43 | 96 |
| Contained amount of Mg (% owf) | 6.9 | 7.7 | 5.9 | 4.5 | 8.7 | 4.6 | 3.5 | 11.1 |
| Saturated moisture absorption rate (%) (20° C./65% RH) | 41 | 40 | 47 | 36 | 40 | 48 | 31 | — |
| Limiting oxygen index (LOI) | 38.5 | 42 | 36 | 35 | 46 | 32 | 29 | — |

Example 2

The same method as in Example 1 was carried out until the step of hydrolysis to prepare a cross-linking fiber having carboxyl group of a sodium salt type. Then said fiber after the hydrolyzing treatment was washed with water, 8 kg of 10% aqueous solution of magnesium nitrate was added thereto and a converting treatment into a magnesium salt type was carried out at 60° C. for 2 hours. After well washing with water, it was subjected to dehydration, oil treatment and drying to give the highly flame-retarding and moisture-absorptive fiber of the present invention. Result of the evaluation of the resulting fiber was as shown in Table 1 that LOI was 42 and saturated moisture absorption rate was 40% whereby both flame-retarding property and moisture-absorptive property showed excellent result. Particularly as compared with Example 1, although the total carboxyl group amount was same, ratio of carboxyl group of a magnesium type was high and, due to an increase in the amount of magnesium contained therein, a sudden improvement in LOI was noted.

Example 3

The same method as in Example 1 was carried out except that, in a converting treatment into a magnesium salt type, 8 kg of 10% aqueous solution of magnesium nitrate was reduced to 3 kg to prepare the highly flame-retarding and moisture-absorptive fiber of the present invention. Result of the evaluation of the resulting fiber was as shown in Table 1 that LOI was 36 and saturated moisture absorption rate was 47% whereby both flame-retarding property and moisture-absorptive property showed good result. Particularly as compared with Example 1, although the total carboxyl group amount was same, ratio of carboxyl group of a magnesium type was low and, due to a relative decrease in the amount of magnesium contained therein, LOI became a bit low value as compared with Example 1. However, with regard to the residual carboxyl group of a salt type, most of it was a sodium salt type and, as a result thereof, a product having a high moisture-absorptive property was prepared.

Example 4

The same method as in Example 2 was carried out except that, in the cross-linking treatment, adding amount of hydrazine hydrate was made 8 kg and the reaction time was made 6 hours to give the highly flame-retarding and moisture-absorptive fiber of the present invention. Result of the evaluation of the resulting fiber was as shown in Table 1 that LOI was 35 and saturated moisture absorption rate was 36% whereby both flame-retarding property and moisture-absorptive property were within allowable levels. As compared with other Examples, although the rate of carboxyl group of a magnesium type was high, amount of carboxyl group of a magnesium type and amount of magnesium contained therein were relatively low probably because the cross-linking took place strongly whereby both flame-retarding property and moisture-absorptive property were in relatively low values.

Example 5

The same method as in Example 1 was carried out except that, in a cross-linking treatment, adding amount of hydrazine hydrate was made 3 kg and the pH adjustment by 1N NaOH was made to 13 to give the highly flame-retarding and moisture-absorptive fiber of the present invention. Result of the evaluation of the resulting fiber was as shown in Table 1 that LOI was 46 and saturated moisture absorption rate was 40% whereby both flame-retarding property and moisture-absorptive property were within very good levels. Even as compared with other Examples, a flame-retarding property was particularly good and, due to the fact that cross-linking was relatively mildly introduced and that pH was raised, all of amount of magnesium-type carboxyl group, rate of magnesium-type carboxyl group and amount of magnesium contained therein were able to achieve high values whereby very high flame-retarding property was likely to be able to be achieved.

Comparative Example 1

The same method as in Example 2 was carried out except that, in a converting treatment into a magnesium salt type, 8 kg of 10% aqueous solution of magnesium nitrate was reduced to 2 kg to give fiber having flame-retarding and moisture-absorptive properties. Result of the evaluation of the resulting fiber was as shown in Table 1 that LOI was 32 and saturated moisture absorption rate was 48% whereby, although moisture-absorptive property was good, flame-retarding property was inferior and that was an insufficient outcome which was insufficient for the use where a high flame-retarding property was demanded. Further, in a burning test, although no flame was noted, a phenomenon where fire remained and spread was observed. The characteristics as such are likely due to the fact that, as a result of insufficient conversion of sodium into magnesium, rate of carboxyl group of a magnesium salt type lowered and amount of carboxyl group of a magnesium salt type and amount of magnesium contained therein were small. With regard to the phenomenon where fire spread, it is presumed to be a phenomenon as a result of such a fact that much amount of carboxyl group of a sodium type was contained therein.

Comparative Example 2

The same method as in Example 1 was carried out except that the pH adjustment by 1N NaOH was made to 7 to give fiber having flame-retarding property and moisture-absorptive property. Result of the evaluation of the resulting fiber was as shown in Table 1 that LOI was 29 and saturated moisture absorption rate was 31% whereby both flame-retarding property and moisture-absorptive property were in very low degree of characteristic and such an outcome was insufficient for the use where a high flame-retarding property and also a high moisture-absorptive property were demanded. Since functional group other than the magnesium salt type carboxyl group in the resulting fiber was a carboxylic acid type (carboxyl group of an H type), it is likely that flame-retarding property and moisture-absorptive property further decreased from sodium of Comparative Example 1.

Comparative Example 3

It was attempted to prepare a fiber having flame-retarding property and moisture-absorptive property by the same method as in Example 2 except that, in the cross-linking treatment, adding amount of hydrazine hydrate was made 1 kg and the reaction was changed to 90° C. for 1 hour and, in the hydrolyzing treatment, concentration of the sodium hydroxide solution was changed to 10%. Until after the hydrolysis, it was able to prepare a product having a fibrous form although it was considerably swollen but, when a converting treatment into magnesium was carried out, pulverization took place and no fiber was obtained. The resulting powder was recovered and evaluated and the result thereof is as shown in Table 1. Thus, it is likely that, since amount of a salt-type carboxyl group is too high, no fibrous shape was able to be retained.

Comparative Example 4

The same method as in Example 1 was carried out except that copper nitrate was used in place of magnesium nitrate to give a fiber having flame-retarding property and moisture-absorptive property. The result of evaluation of the resulting fiber was that amount of carboxyl group of a copper salt type was 5.7 mmol/g, rate of carboxyl group of a copper salt type was 84% and content of copper ion in the fiber was 18.1%. LOI and moisture absorption rate of said fiber were 34 and 28%, respectively and LOI was somewhat insufficient for the use where a highly flame-retarding property was demanded and a moisture-absorptive property was low as well. When specific gravity of the resulting fiber was measured, it was 2.1 g/cm$^3$ and was considerably heavy as compared with common fiber whereby it was not suitable for the use such as for clothing. In addition, said fiber contained copper which was heavy metal causing a problem in view of safety and to environment.

Example 6

The fiber of the present invention prepared in Example 1 (mixing ratio: 30%) and a flame-retarding polyester fiber (manufactured by Toyobo, trade name "HEIM") (mixing ratio: 70%) were used and subjected to mixed spinning, carding, drawing and crude spinning by conventional methods to prepare yarn of 1/40 metric count and 630 T/M twisted numbers. Then this yarn was applied to a smooth knitting machine of 20 gauzes to prepare a knitted cloth of 200±20 g/m$^2$ basis weight. There was no problem in view of in its processing property and a knitted cloth which was a fiber structure of the present invention was able to be prepared. When LOI of the resulting knitted cloth was measured, it was 32 whereby a higher flame-retarding property than in the case of the conventional flame-retarding polyester only was able to be confirmed. Moreover, in the case of the flame-retarding polyester fiber only, shrinking happens by flame but this knitted cloth had a characteristic that no shrinking happened.

When an antistatic property of the resulting cloth was evaluated, its friction electrical strength was 700 V while its half life was 0.1 second which was the limiting level for the measurement whereby the cloth had very high antistatic property. Due to the characteristics as such, generation of static electricity is able to be prevented and it is now possible to prevent fire, explosion, etc. caused by electrostatic spark.

Example 7

The fiber of the present invention prepared in Example 1 (mixing ratio: 20%) and a flame-retarding polyester fiber (manufactured by Toyobo, trade name "HEIM") (mixing ratio: 80%) were uniformly subjected to a mixed spinning to spin a yarn of 1/52 metric count (700 T/M twisted numbers). From warps prepared by pasting the resulting yarn with a paste mainly comprising PVA and warping and woofs prepared by dyeing the resulting yarn with a package dyeing machine without pasting, a plain weave fabric of 90 warps/inch density and 70 woofs/inch density was woven by using a high-speed weaving machine and the woven fabric was depasted, scoured, applied with 0.3% by weight (to the fabric) of a texture adjusting agent (anionic softener) and subjected to a heating treatment for 1 minute in a hot-air drying machine where hot-air temperature was 150° C. to prepare a sample of a woven product of 120 g/m$^2$ basis weight which was the fiber structure of the present invention. When LOI of the resulting woven product was measured, it had a flame-retarding property of as good as 31.

Example 8

The fiber of the present invention prepared in Example 1 (mixing ratio: 50%) and a flame-retarding polyester fiber (manufactured by Toyobo, trade name "HEIM") (mixing ratio: 50%) were mixed, subjected to a preliminary opening using a fiber-blending machine and made into needle-punched cloth of 200 g/m$^2$ basis weight using an apparatus in which a lattice providing the raw stock, a flat card, a device for piling the card web and a needling device were connected. After that, the cloth was subjected to a heating treatment at 160° C. for 60 seconds and then passed at the speed of 10 m/minute through two calendar rollers designed at 160° C. to prepare a nonwoven fabric which was the fiber structure of the present invention. When LOI of the resulting nonwoven fabric was measured, it had a flame-retarding property of as high as 35. Burning with a lighter was also attempted but, although it was in a combustible form of nonwoven fabric, burning was rarely noted having a very good flame-retarding property.

The invention claimed is:

1. A highly flame-retarding and moisture-absorptive fiber, which comprises an organic polymer having a cross-linking structure and a salt-type carboxyl group in which at least a part of such a salt-type carboxyl group is a magnesium salt type and a saturated moisture absorption rate at 20° C. and 65% relative humidity and a limiting oxygen index are not less than 35% by weight and not less than 35, respectively.

2. The highly flame-retarding and moisture-absorptive fiber according to claim 1, wherein the cross-linking structure comprises an amine structure prepared by the reaction of a hydrazine compound with nitrile group contained in a high nitrile polymer where content of vinyl monomer having nitrile group is not less than 50% by weight.

3. The highly flame-retarding and moisture-absorptive fiber according to claim 1, wherein the salt-type carboxyl group to the fiber is 3 to 9 mmol/g and not less than 70% of such a salt-type carboxyl group is a magnesium salt type.

4. The highly flame-retarding and moisture-absorptive fiber according to claim 1, wherein the fiber contains not less than 4% by weight of magnesium.

5. The highly flame-retarding and moisture-absorptive fiber according to claim 1, wherein specific gravity of the fiber is not more than 1.8 g/cm$^3$.

6. A flame-retarding fiber structure, wherein the highly flame-retarding and moisture-absorptive fiber of claim 1 is present in at least a part of the structure.

7. The flame-retarding fiber structure according to claim 6, wherein a limiting oxygen index is not less than 28.

* * * * *